US008353118B2

(12) United States Patent
Noël

(10) Patent No.: US 8,353,118 B2
(45) Date of Patent: Jan. 15, 2013

(54) PEAT MOSS HARVESTING APPARATUS AND METHOD

(75) Inventor: Philippe Noël, Tracadie-Sheila (CA)

(73) Assignee: NCL Holding Inc., Tracadie-Sheila (CA)

( * ) Notice: Subject to any disclaimer, the term of this patent is extended or adjusted under 35 U.S.C. 154(b) by 16 days.

(21) Appl. No.: 12/957,454

(22) Filed: Dec. 1, 2010

(65) Prior Publication Data

US 2012/0137546 A1 Jun. 7, 2012

(51) Int. Cl.
*E21C 49/00* (2006.01)

(52) U.S. Cl. ..... 37/3

(58) Field of Classification Search ..... 171/14, 171/15, 27, 130, 132, 28, 18, 41, 44, 56, 171/111, 112; 100/72–75; 299/39, 64, 67, 299/89, 76–79; 37/3, 319, 340–347, 445, 37/426, 403–410, 466, 468; 56/8, 16.5, 155, 56/293

See application file for complete search history.

(56) References Cited

U.S. PATENT DOCUMENTS

| | | | | |
|---|---|---|---|---|
| 1,470,221 | A | 10/1923 | Freeman | |
| 1,763,786 | A | 6/1930 | Huffman | |
| 3,540,535 | A | 11/1970 | Brouwer et al. | |
| 3,584,690 | A * | 6/1971 | Taylor | 171/27 |
| 3,628,609 | A * | 12/1971 | Graybill | 171/14 |
| 4,088,236 | A | 5/1978 | Moore | |
| 4,166,505 | A * | 9/1979 | West | 171/1 |
| 4,417,982 | A * | 11/1983 | Britschgi et al. | 210/386 |
| 4,495,716 | A | 1/1985 | Finan et al. | |
| 4,616,880 | A * | 10/1986 | Nozaki et al. | 299/39.2 |
| 5,477,627 | A * | 12/1995 | Nolin et al. | 37/3 |
| 5,813,151 | A | 9/1998 | Stephens et al. | |
| 7,243,690 | B1 | 7/2007 | Price et al. | |
| 7,284,345 | B2 * | 10/2007 | Schenk | 37/403 |
| 7,507,265 | B2 * | 3/2009 | Mutka et al. | 44/490 |

FOREIGN PATENT DOCUMENTS

| | | | |
|---|---|---|---|
| CA | 2065923 | C | 10/1993 |
| GB | 315678 | A | 7/1929 |

OTHER PUBLICATIONS

Extended European Search Report issued Jun. 15, 2012 in respect of European Application No. 11180482.9.

* cited by examiner

*Primary Examiner* — Robert Pezzuto
(74) *Attorney, Agent, or Firm* — Bereskin & Parr LLP/S.E.N.C.R.L., s.r.l.

(57) ABSTRACT

A peat moss harvesting apparatus includes a conveyor mechanism and a cutting mechanism. The cutting mechanism is guided through a peat moss bed to cut a section of peat moss. The section of peat moss is progressively loaded onto the conveyor mechanism as the section of peat moss is being cut.

19 Claims, 6 Drawing Sheets

PEAT MOSS HARVESTING APPARATUS AND METHOD

FIELD

This specification relates to apparatuses for harvesting peat moss and methods of harvesting peat moss.

BACKGROUND

The following paragraphs are not an admission that anything discussed in them is prior art or part of the knowledge of persons skilled in the art.

Canadian Patent No. 2,065,923 describes an attachment mounted to an articulated boom of a carrier vehicle for harvesting and dewatering peat moss material. The attachment comprises an apertured bucket for digging peat moss material and a ram movable with relation to the bucket between an extended position and a retracted position. The ram and the bucket define a variable volume press chamber which is contractible in response to movement of the ram member toward the extended position for expressing water from the load of peat moss material gathered in the bucket. A method for harvesting and dewatering peat moss material is also described.

SUMMARY

In an aspect of this specification, a peat moss harvesting apparatus can comprise: a supporting structure attachable to a carrier vehicle, the supporting structure including a forward edge and a rearward edge; a conveyor mechanism mounted to the supporting structure, and configured to convey material from the forward edge to the rearward edge; a cutting mechanism mounted generally across the forward edge of the supporting structure, and guidable through a peat moss bed to cut a section of peat moss from the peat moss bed, the section of peat moss progressively loaded onto the conveyor mechanism as the section of peat moss is cut; and a pass guide element arranged generally underneath the cutting mechanism at the forward edge, and configured to engage the peat moss bed as the cutting mechanism is guided through the peat moss bed.

In an aspect of this specification, a peat moss harvesting apparatus can comprise: a supporting structure attachable to a carrier vehicle, the supporting structure including a forward edge and a rearward edge; a conveyor mechanism mounted to the supporting structure, the conveyor mechanism including at least one belt configured to convey material from the forward edge to the rearward edge; a transverse cutting mechanism mounted generally across the forward edge, the cutting mechanism including at least one guide bar and at least one cutting chain configured to be driven around the guide bar; and at least one upright cutting mechanism arranged at the forward edge and adjacent to an end of the transverse cutting mechanism, the at least one upright cutting mechanism including a side guide bar and a side cutting chain configured to be driven around the side guide bar.

In an aspect of this specification, a method of harvesting peat moss can comprise guiding a cutting mechanism along a generally arcuate path through a peat moss bed to cut a section of peat moss therefrom, and progressively loading the section of peat moss onto a supporting structure as the section of peat moss is being cut.

Other aspects and features of the teachings disclosed herein will become apparent, to those ordinarily skilled in the art, upon review of the following description of the specific examples of the specification.

DRAWINGS

The drawings included herewith are for illustrating various examples of articles, methods, and apparatuses of the present specification and are not intended to limit the scope of what is taught in any way. In the drawings.

DETAILED DESCRIPTION

Various apparatuses or processes will be described below to provide an example of an embodiment of each claimed invention. No embodiment described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention. The applicants, inventors or owners reserve all rights that they may have in any invention disclosed in an apparatus or process described below that is not claimed in this document, for example the right to claim such an invention in a continuing application and do not intend to abandon, disclaim or dedicate to the public any such invention by its disclosure in this document.

Figure 1:
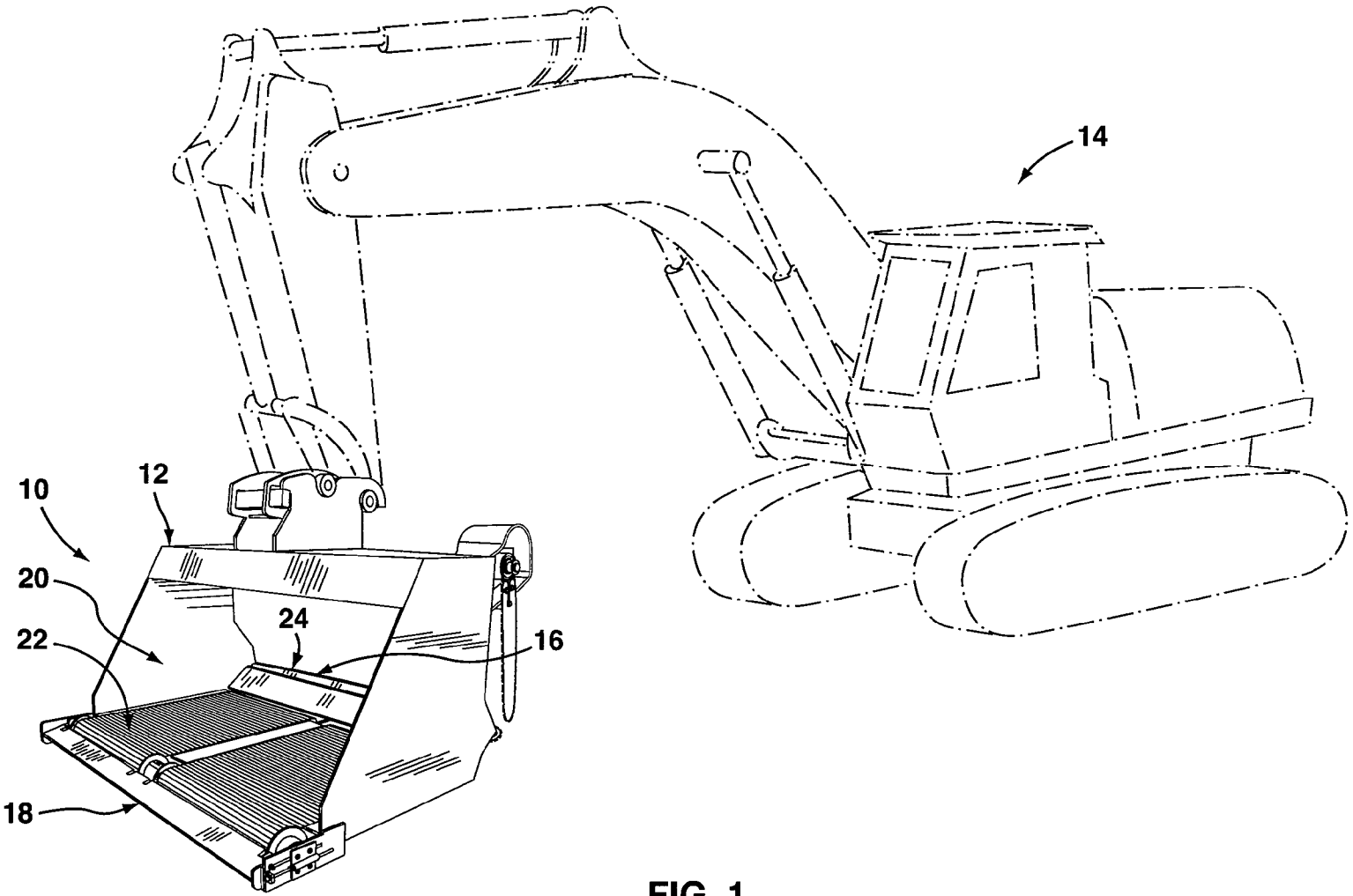
FIG. 1 is a perspective view of a peat moss harvesting apparatus attached to a carrier vehicle.

Referring to FIG. 1, an example of a peat moss harvesting apparatus is shown generally at 10. The apparatus 10 includes a supporting structure 12. The supporting structure 12 is attachable to a carrier vehicle 14. The supporting structure 12 includes a transverse forward edge 16 and a transverse rearward edge 18, and defines a load chamber 20 arranged between the forward and rearward edges 16, 18. In the example illustrated, the carrier vehicle 14 is a tractor, and the supporting structure 12 is shown attached to an articulated boom of the tractor. The apparatus 10 also includes a conveyor mechanism 22 mounted to the supporting structure 12. The conveyor mechanism 22 is configured to convey material in the load chamber 20 from the forward edge 16 to the rearward edge 18. The apparatus 10 further includes a cutting mechanism 24 mounted transversely generally across the forward edge 16 of the supporting structure 12. In use, the cutting mechanism 24 is guided through a peat moss bed to cut a section of peat moss therefrom, and the section of peat moss is progressively loaded onto the conveyor mechanism 22 as the section of peat moss is being cut.

Figure 2:
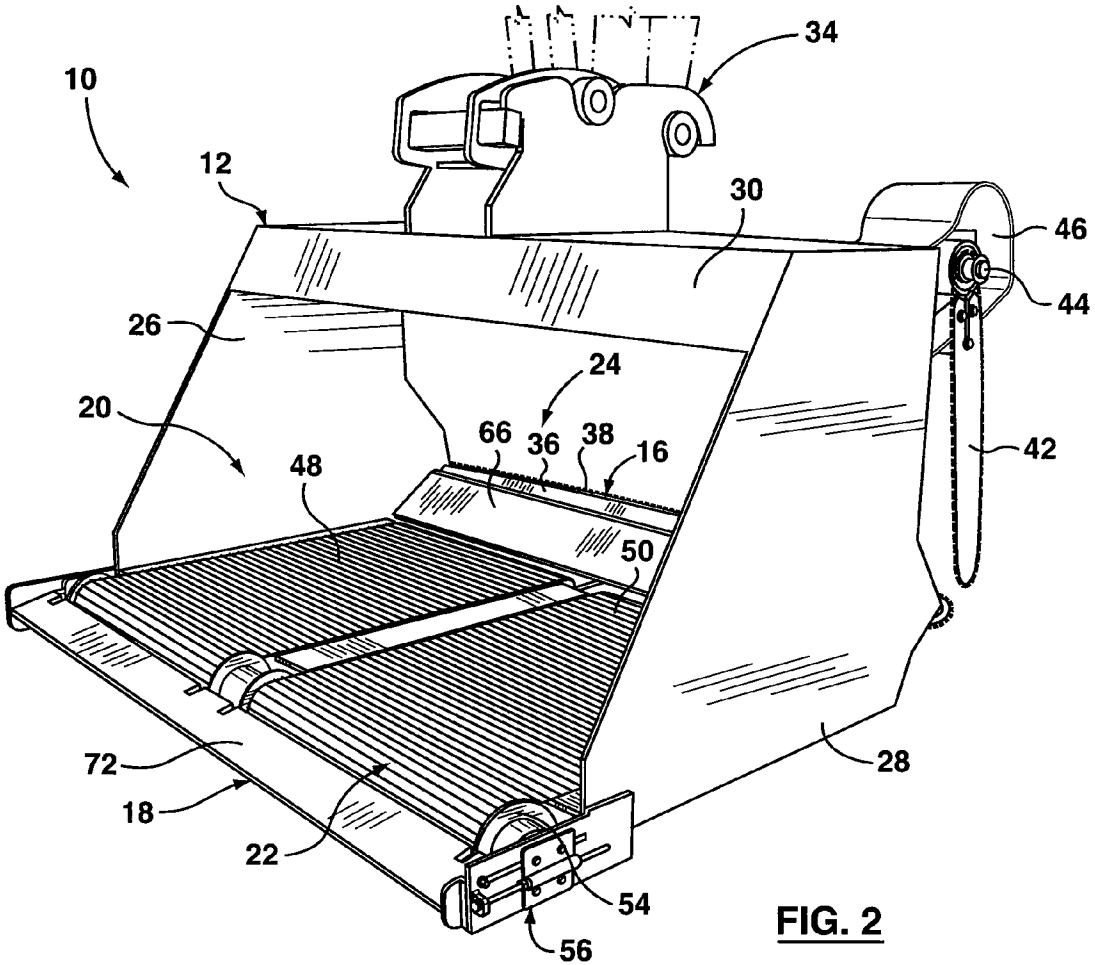
FIG. 2 is a detailed perspective view of the apparatus of FIG. 1.
Figure 3A:
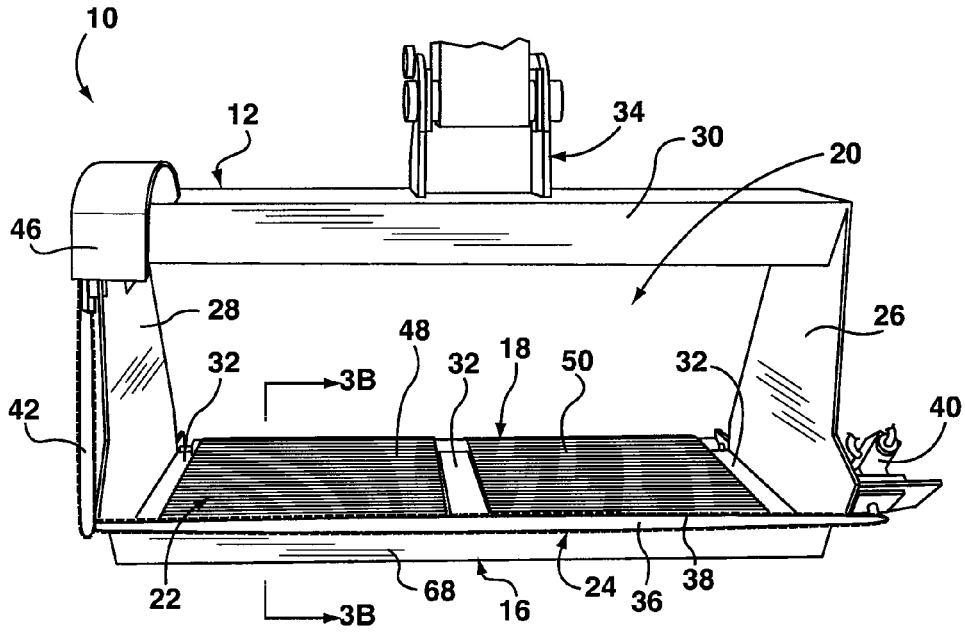
FIG. 3A is a front view of the apparatus of FIG. 1.
Figure 3B:
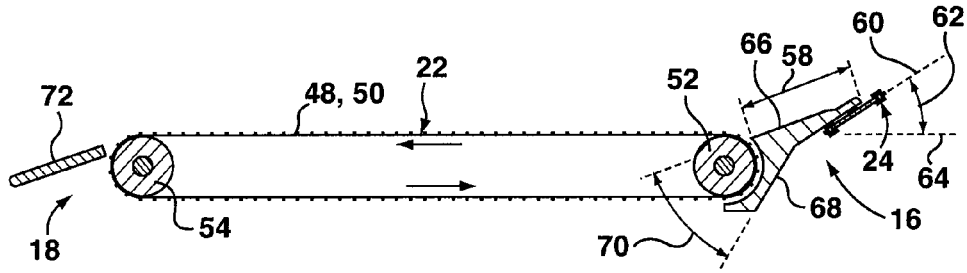
FIG. 3B is a sectional view taken from FIG. 3A.

In the example illustrated, referring now to FIGS. 2, 3A and 3B, the supporting structure 12 includes a right side wall 26 and a left side wall 28 spaced apart from the right side wall 26. Top and bottom frame members 30, 32 span between the right and left side walls 26, 28. The right and left side walls 26, 28 and top and bottom frame members 30, 32 generally enclose the load chamber 20. The top frame member 30 can include a connection device 34 facilitating attachment to the carrier vehicle 14 (FIG. 1).

In the example illustrated, referring particularly to FIG. 3B, the cutting mechanism 24 is offset forwardly relative to the conveyor mechanism 22 by an offset dimension 58. In some examples, the offset dimension 58 is between about 6 to 14 inches, or between about 10 to 14 inches. Further, a cutting plane 60, which is defined by the cutting mechanism 24, is disposed at an inclined angle 62 relative to a belt plane 64, which is defined by an upper surface of belts 48, 50 of the conveyor mechanism 22. In some examples, the inclined angle is between about 25 and 40 degrees, or between about 30 and 35 degrees. The offset dimension 58 and the inclined angle 62 can generally facilitate the cutting mechanism 24 being guided along an arcuate path through the peat moss bed during cutting (as described below, with reference to FIGS. 4A to 4E and/or FIGS. 5A to 5E).

A cut guide element 66 can be arranged generally between the cutting mechanism 24 and the upper surface of the belts 48, 50 of the conveyor mechanism 22 at the forward edge 16. The cut guide element 66 is configured to direct a section of peat moss from the cutting mechanism 24 to the conveyor mechanism 22 to be progressively loaded thereon.

A pass guide element 68 can be arranged generally underneath the cutting mechanism 24 at the forward edge 16. The pass guide element 68 is configured to engage and ride along the surface of peat moss bed, following the cutting mechanism 24 as it is guided through the peat moss bed and the section of peat moss is being cut. Spacing between the elements 66, 68 can generally facilitate a physical separation between the cut section of peat moss and the peat moss bed, so as to accommodate the conveyor mechanism 22 as the apparatus 10 is guided through the peat moss bed. In the example illustrated, the cut guide element 66 and the pass guide element 68 are arranged at a diverging angle 70 in relation to the cutting mechanism 24. The cut guide element 66 and the pass guide element 68 can be formed of separate components, or, as illustrated, can be an integral component.

A rear guide element 72 can be arranged close to the upper surface of the belts 48, 50 of the conveyor mechanism 22 at the rearward edge 18. The rear guide element 72 is configured to guide the section of peat moss as it is being unloaded from the conveyor mechanism 22.

A section of freshly harvested peat moss can be relatively heavy due to its water content. For example, a 4×8 foot section of peat moss that is 20 to 30 inches thick can weigh up to 3,000 pounds. In the example illustrated, with continued reference to FIGS. 2, 3A and 3B, the conveyor mechanism 22 includes first and second belts 48, 50 suspended in a side-by-side relationship. Mass of a section of peat moss loaded onto the supporting structure 12 can therefore be distributed between the first and second belts 48, 50. In other examples, the conveyor mechanism can include two or more belts, suspended in side-by-side and/or front-to-back relationships.

In the example illustrated, the first and second belts 48, 50 are suspended between a first pulley 52 (shown in FIG. 3B) and a second pulley 54. The pulleys 52, 54 can be mounted to the bottom frame member 32 adjacent to the edges 16, 18, respectively. The pulleys 52, 54 can each consist of a single element extending transversely between the side walls 26, 28, or two or more elements aligned in series between the side walls 26, 28, so that the mass of a section of peat moss can be distributed over a plurality of load-bearing elements. An adjustment device 56 (shown in FIG. 2) can be provided coupling the second pulley 54 to the supporting structure 12, which can be used to vary the distance between the pulleys 52, 54 and thus adjust tension on the belts 48, 50. Further, one or more scraper members (not shown) can be provided internally or externally relative to the belts 48, 50 to clean the belts 48, 50 as they are driven between the pulleys 52, 54.

In some examples, as illustrated, the belts 48, 50 can include outer traction features, for example, ⅛" transversely extending ribs or corrugations, providing traction between the conveyor mechanism 22 and the section of peat moss while it is being conveyed by the conveyor mechanism 22. The belts 48, 50 can each be formed of a resilient material having a relatively high tensile strength. The belts 48, 50 can also each be formed of a non-slip, wear resistant material. Further, the belts 48, 50 can each be formed of a single layer, or more than one layer, including at least one inner base layer and at least one outer liner layer.

For the belts 48, 50, the inventors have obtained satisfactory results using FP19-3™ belts (Transforce Beltal Inc. of Bunham, Quebec), in combination with REMALINE 40™ linings (REMA TIP TOP/North America Inc. of Madison, Ga.).

Peat moss can consist of up to 10% or more of wood material, and thus it is desirable for the cutting mechanism 24 to have sufficient power and capability to cut through wood cleanly and without excessive damage to the peat moss surrounding the area of the cut. In the example illustrated, the cutting mechanism 24 takes the form of a chainsaw device, including a guide bar 36 and a cutting chain 38. A first cutting motor 40 is provided to drive the cutting chain 38 around the guide bar 36. In the example illustrated, the cutting chain 38 spans the transverse width of the forward edge 16 (which can be, for example, 48 inches wide), although the cutting mechanism 24 can include more than one guide bar and cutting chain arranged in alignment across the forward edge 16.

The apparatus 10 can further include at least one upright or vertical cutting mechanism 42 mounted to the supporting structure 12 and arranged at the forward edge 16, adjacent to an end of the cutting mechanism 24 at the right and/or left side walls 26, 28. In the example illustrated, the upright cutting mechanism 42 also takes the form of a chainsaw device and includes a guide bar and a cutting chain. The upright cutting mechanism 42 is driven by a second cutting motor 44, and at least a portion of the upright cutting mechanism 42 and the motor 44 can be enclosed by a guard 46. The apparatus 10 can include a single upright cutting mechanism 42 arranged adjacent to one side, as shown, or two upright cutting mechanisms 42 arranged on either side of the forward edge 16, adjacent to the right and left side walls 26, 28.

For the cutting mechanisms 24, 42, the inventors have obtained satisfactory results using OREGON™ chain, bar and sprocket products (Blount Inc. of Portland, Oreg.).

The apparatus 10 can further include various electrical cables, hydraulic/pneumatic lines and other power connections for controlling the cutting motors 40, 44, the motor (not shown) for driving the belts 48, 50, and/or other components, which have been omitted from the drawings for the purposes of clarity. Further, a central controller (not shown) can be provided to allow an operator to centrally control a cutting operation of the apparatus 10 by controlling belt speed of the conveyor mechanism 22 and actuation of the cutting mechanism 24. The central controller can be housed alongside other controls in the carrier vehicle.

Figure 4A:
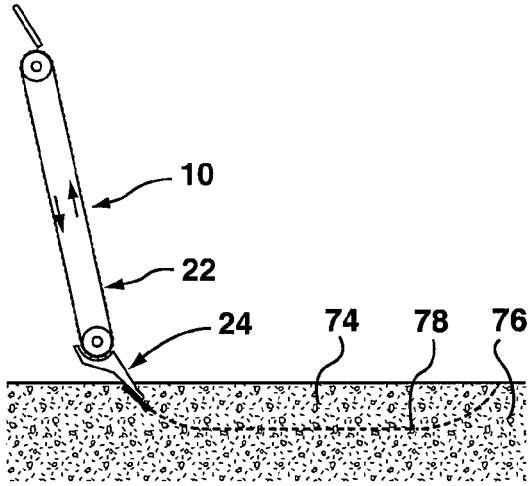
FIGS. 4A to 4E are a series of side, sectional, schematic views of the apparatus of FIG. 1 harvesting a section of peat moss from a peat moss bed.
Figure 4B:
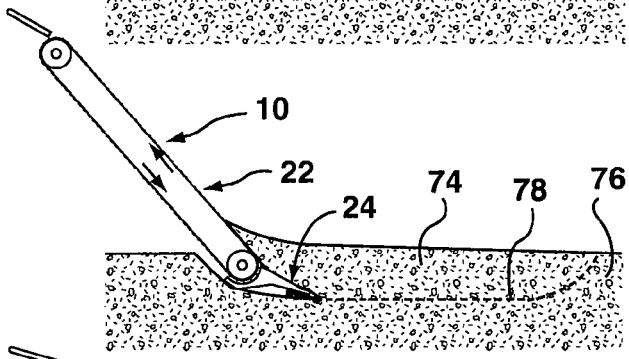
Figure 4C:
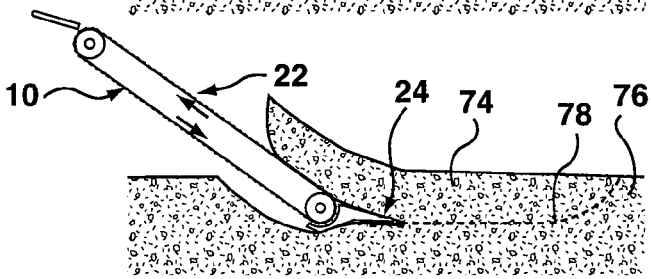
Figure 4D:
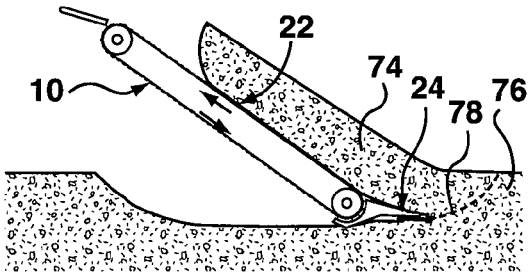

FIGS. 4A to 4E schematically illustrate the apparatus 10 cutting a section of peat moss 74 from a peat moss bed 76, and progressively loading the section of peat moss 74 onto the conveyor mechanism 22 as the section of peat moss 76 is being cut by the cutting mechanism 24. Referring to FIG. 4A, the cutting mechanism 24 can be actuated before engaging the peat moss bed 76, and the conveyor mechanism 22 can be driven, with a belt speed selected to generally match a speed in which the cutting mechanism 24 is guided through the peat moss bed 76. FIG. 4A illustrates the apparatus 10 oriented at a relatively steep angle of attack as the apparatus 10 engages the peat moss bed 76.

Figure 4E:
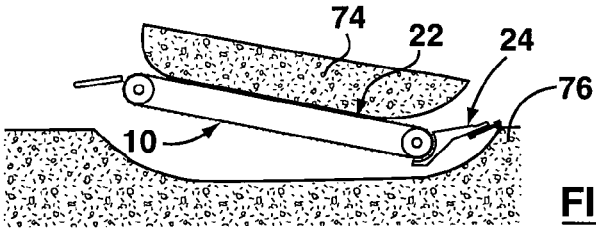

As illustrated, referring to FIGS. 4B to 4E, the cutting mechanism 24 is guided along a generally arcuate or non-linear path 78 through the peat moss bed 76 to cut the section of peat moss 74. Again, a belt speed of the conveyor mechanism 22 can be maintained to generally match the cutting speed in which the cutting mechanism 24 is guided through the peat moss bed 76, so that the section of peat moss 74 is progressively loaded onto the conveyor mechanism 22. As the section of peat moss 74 is being cut, as illustrated, the apparatus 10 can be rotated about the section of peat moss 74 so that the rearward edge is moved downwardly relative to the forward edge, defining what can be described as a "scooping action" of the apparatus 10 relative to the peat moss bed 76. After the section of peat moss 74 has been cut from the peat moss bed 76, as shown in FIG. 4E, the conveyor mechanism 22 can be stopped so that the section of peat moss 74 is retained thereon.

By cutting the section of peat moss 76 in this manner, the section of peat moss 74 can be supported by the apparatus 10 generally throughout the cutting operation, so that the structure of the section of peat moss 74 is maintained generally intact and without significant fibre breakage, which can cause an undesirable chain reaction of decomposition.

Figure 5A:
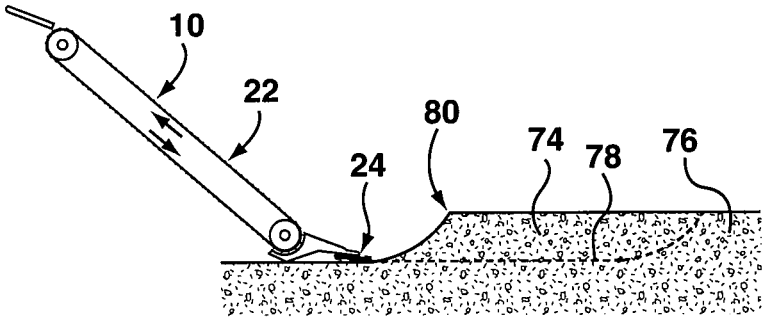
FIGS. 5A to 5E are a series of side, sectional, schematic views of the apparatus of FIG. 1 harvesting a section of peat moss from another peat moss bed.
Figure 5B:
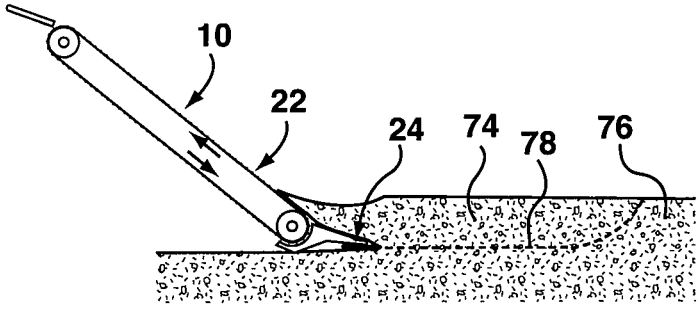
Figure 5C:
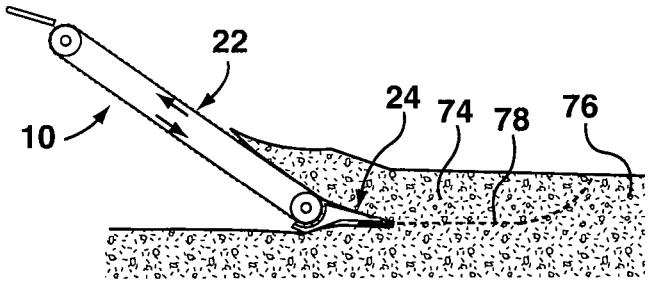
Figure 5D:
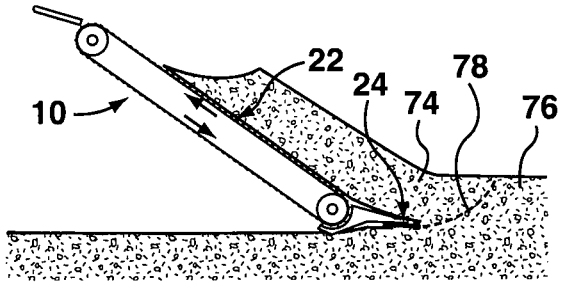
Figure 5E:
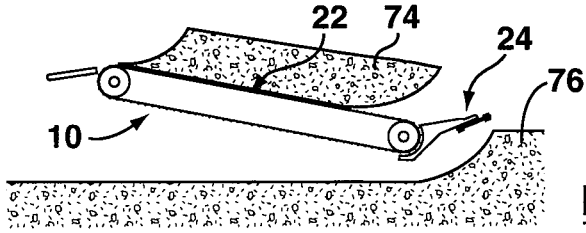

FIGS. 5A to 5E are generally similar to FIGS. 4B to 4E, with the difference being that the peat moss bed 76 includes a lip 80 formed from an earlier cutting operation. FIG. 5A illustrates the apparatus 10 oriented at a lesser angle of attack, in comparison to FIG. 4A, as the apparatus 10 engages the peat moss bed 76. The cutting operation shown in FIGS. 5A to 5E can be repeated continuously along a row at a harvesting site, with each new section of peat moss being cut beginning roughly at the lip 80 formed by a previous cutting operation.

It should be appreciated that, referring back to FIG. 3A, a single upright cutting mechanism 42 can be sufficient if cutting operations at a harvesting site are conducted in a pattern of adjacent rows, in which a section of peat moss that is being cut lies directly adjacent to an open space created by a previous cutting operation, so that only a single side cut is necessary to free the section of peat moss from the peat moss bed.

Figure 6A:
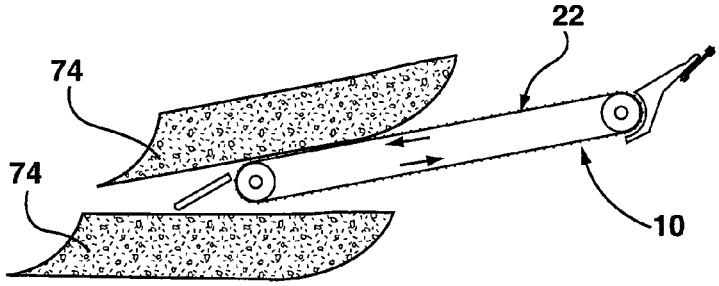
FIGS. 6A to 6C are a series of side, sectional, schematic views of the apparatus of FIG. 1 unloading a section of peat moss.
Figure 6B:
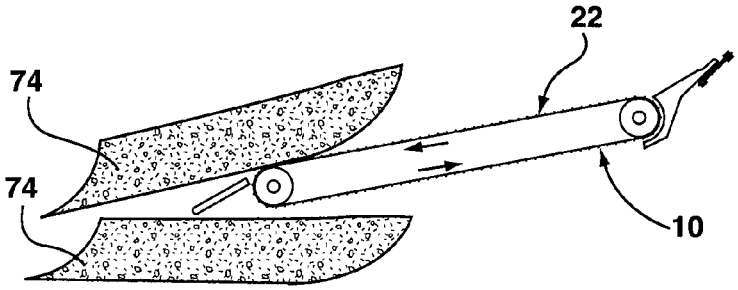
Figure 6C:
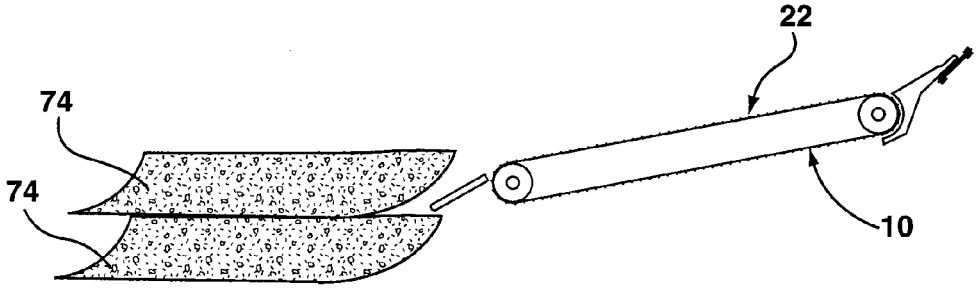

After cutting the section of peat moss 74, the apparatus can be moved to another location to unload the section of peat moss 74, which can be unloaded and stacked, for example, on the ground or onto pallets for further transport. FIGS. 6A to 6C schematically illustrate the apparatus 10 progressively unloading the section of peat moss 74, and stacking the section of peat moss 74 onto another section.

While the above description provides examples of one or more processes or apparatuses, it will be appreciated that other processes or apparatuses may be within the scope of the accompanying claims.

I claim:

1. A peat moss harvesting apparatus, comprising:

a supporting structure attachable to a carrier vehicle, the supporting structure including a forward edge and a rearward edge;

a conveyor mechanism mounted to the supporting structure, and configured to convey material from the forward edge to the rearward edge;

a cutting mechanism mounted generally across the forward edge of the supporting structure and offset forwardly from the conveyor mechanism, the cutting mechanism guidable through a peat moss bed to cut a section of peat moss from the peat moss bed;

a cut guide element arranged generally between the cutting mechanism and the conveyor mechanism, and configured to direct the section of peat moss from the cutting mechanism to be progressively loaded onto the conveyor mechanism as the section of peat moss is cut; and a pass guide element arranged generally underneath and rearwardly of the cutting mechanism at the forward edge, and configured to engage the peat moss bed as the cutting mechanism is guided through the peat moss bed, wherein the cut guide element and the pass guide element are spaced apart for facilitating a physical separation between the section of peat moss and the peat moss bed, so as to accommodate the conveyor mechanism as the apparatus is guided along a generally arcuate path through the peat moss bed.

2. The apparatus of claim 1, wherein the cutting mechanism is offset forwardly from the conveyor mechanism a dimension between 6 and 14 inches.

3. The apparatus of claim 1, wherein the cutting mechanism is disposed at an inclined angle relative to the conveyor mechanism.

4. The apparatus of claim 3, wherein the cutting mechanism is disposed at an angle between 25 and 40 degrees relative to an upper surface of the conveyor mechanism.

5. The apparatus of claim 3, wherein the cut and pass guide elements are arranged at a diverging angle relative to the cutting mechanism.

6. The apparatus of claim 1, wherein the conveyor mechanism comprises at least one belt suspended between a first pulley arranged adjacent to the forward edge and a second pulley arranged adjacent to the rearward edge.

7. The apparatus of claim 6, wherein the conveyor mechanism comprises first and second belts suspended in a side-by-side relationship between the first and second pulleys.

8. The apparatus of claim 6, wherein the at least one belt comprises outer traction features.

9. The apparatus of claim 6, wherein the at least one belt comprises an outer non-slip lining.

10. The apparatus of claim 1, wherein the cutting mechanism comprises at least one guide bar and at least one cutting chain configured to be driven around the guide bar.

11. The apparatus of claim 1, comprising at least one upright cutting mechanism arranged at the forward edge, adjacent to the cutting mechanism.

12. The apparatus of claim 11, wherein the at least one upright cutting mechanism comprises a side guide bar and a side cutting chain configured to be driven around the side guide bar.

13. A peat moss harvesting apparatus, comprising:

a supporting structure attachable to a carrier vehicle, the supporting structure including a forward edge and a rearward edge;

a conveyor mechanism mounted to the supporting structure, the conveyor mechanism including at least one belt configured to convey material from the forward edge to the rearward edge;

a transverse cutting mechanism mounted generally across the forward edge, the cutting mechanism including at least one guide bar and at least one cutting chain configured to be driven around the guide bar; and at least one upright cutting mechanism arranged at the forward edge and adjacent to an end of the transverse cutting mechanism, the at least one upright cutting mechanism including a side guide bar and a side cutting chain configured to be driven around the side guide bar.

14. A method of harvesting peat moss, comprising:

guiding a cutting mechanism along a generally arcuate path through a peat moss bed to cut a section of peat moss therefrom;

driving a conveyor mechanism to progressively load the section of peat moss onto a supporting structure;

progressively loading the section of peat moss onto the supporting structure as the section of peat moss is being cut; and selecting a belt speed of the conveyor mechanism to generally match a speed in which the cutting mechanism is guided through the peat moss bed.

15. The method of claim 14, comprising providing an apparatus comprising the supporting structure and the cutting mechanism, the cutting mechanism mounted generally across a forward edge of the supporting structure.

16. The method of claim 15, comprising, as the section of peat moss is being cut, rotating the apparatus about the section of peat moss so that a rearward edge of the supporting structure is moved downwardly relative to the forward edge.

17. The method of claim 14, comprising driving at least one cutting chain as the cutting mechanism to cut the section of peat moss.

18. The method of claim 14, further comprising, after the section of peat moss has been cut from the peat moss bed, stopping the conveyor mechanism so that the section of peat moss is retained on the supporting structure.

19. The method of claim 18, further comprising, after stopping the conveyor mechanism, moving the supporting structure to a different location, and driving the conveyor mechanism to progressively unload the section of peat moss from the supporting structure.

* * * * *